US007394439B1

(12) United States Patent
Johnson et al.

(10) Patent No.: US 7,394,439 B1
(45) **Date of Patent: *Jul. 1, 2008**

(54) MULTI-LINK ANTENNA ARRAY THAT CONFORMS TO CELLULAR LEASING AGREEMENTS FOR ONLY ONE ATTACHMENT FEE

(75) Inventors: Harold W. Johnson, Roach, MO (US); Bruce E. Hoffman, Overland Park, KS (US); Walter F. Rausch, Shawnee, KS (US)

(73) Assignee: SprintCommunications Company L.P., Overland Park, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/471,069

(22) Filed: Jun. 19, 2006

(51) Int. Cl.
*H01Q 1/12* (2006.01)

(52) U.S. Cl. ..... 343/890; 343/878

(58) Field of Classification Search ..... 343/700 MS, 343/878, 890, 853, 702
See application file for complete search history.

(56) References Cited

U.S. PATENT DOCUMENTS

| | | | | |
|---|---|---|---|---|
| 5,884,166 | A * | 3/1999 | Ray et al. | 455/431 |
| 5,898,904 | A * | 4/1999 | Wang | 340/7.27 |
| 6,222,503 | B1 * | 4/2001 | Gietema et al. | 343/890 |
| 6,947,008 | B2 * | 9/2005 | Tillery et al. | 343/824 |

* cited by examiner

*Primary Examiner*—Tho G Phan

(57) ABSTRACT

A system and method for mounting a plurality of antenna elements onto a cell tower is disclosed. A plurality of antennas are mounted onto a mounting system. The mounting system is configured to attach to a cellular antenna mount using the same physical mounting system as the cellular antenna elements. The plurality of antennas provide multiple point-to-point links that may be used for wireless backhaul links or other applications.

44 Claims, 5 Drawing Sheets

MULTI-LINK ANTENNA ARRAY THAT CONFORMS TO CELLULAR LEASING AGREEMENTS FOR ONLY ONE ATTACHMENT FEE

RELATED APPLICATIONS

This application is related to the application "Multi-link antenna array configured for cellular site placement" and "Hybrid architecture that combines a MAN fiber system with a Multi-link antenna array" that were filed on the same day as the current application and are hereby incorporated by reference.

FEDERALLY SPONSORED RESEARCH OR DEVELOPMENT

Not applicable

MICROFICHE APPENDIX

Not applicable

BACKGROUND OF THE INVENTION

1. Field of the Invention

The invention is related to the field of communications, and in particular, to communication antennas.

2. Description of the Prior Art

Most cellular backhaul uses Incumbent local exchange carrier (ILEC) TI circuits. ILEC circuits are expensive and do not scale economically as cell backhaul demand increases, especially for wireless data and video. Using point-to-point or point-to-multipoint radio or microwave links for cellular backhaul links can be costly. One of the cost drivers is the cost of real estate on cell towers. In this application the term "cell tower" includes all manner of cellular mounting structure, for example building sites, towers, treelike structures, and the like. Cell tower leasing agreements typically charge a fee for each antenna element mounted to the tower, and a fee based on the number of cables running up the tower that attach to the antenna elements.

Therefore there is a need for a system and method that allows multiple antenna elements to be mounted onto a cell tower at a minimum cost.

The spectrum available for the radio and microwave point-to-point and point-to-multipoint links is also restricted. Common carrier bands at 2, 4 and 6 GHz, especially the 4 GHz band, are under utilized today. The original and primary use of the bands was for long distance telecommunication across the US. The long distance links where typically operated by AT&T, MCI and other telephone companies. The long distance radio frequency (RF) links had link distances of 30 miles or more. These long distance links require large antennas. These antennas had to be mounted individually on cell towers and the leasing cost on cell towers is based, in part, on the number of mountings used. The large microwave antennas also created wind loading problems on cell towers. Today these companies and new operators typically utilize fiber optic transcontinental networks for Long Distance telecommunications. Deployment of fiber networks has rendered the 4 GHz band as highly under utilized and available for other uses.

Therefore there is a need for a system and method that utilizes these common carrier bands for point-to-point links.

SUMMARY OF THE INVENTION

A system and method for mounting a plurality of antenna elements onto a cell tower is disclosed. A plurality of antennas are mounted onto a mounting system. The mounting system is configured to attach to a cellular antenna mount using the same physical mounting system as the cellular antenna elements. The plurality of antennas provide multiple point-to-point links that may be used for wireless backhaul links or other applications.

DETAILED DESCRIPTION OF THE PREFERRED EMBODIMENT

FIGS. 1-5 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
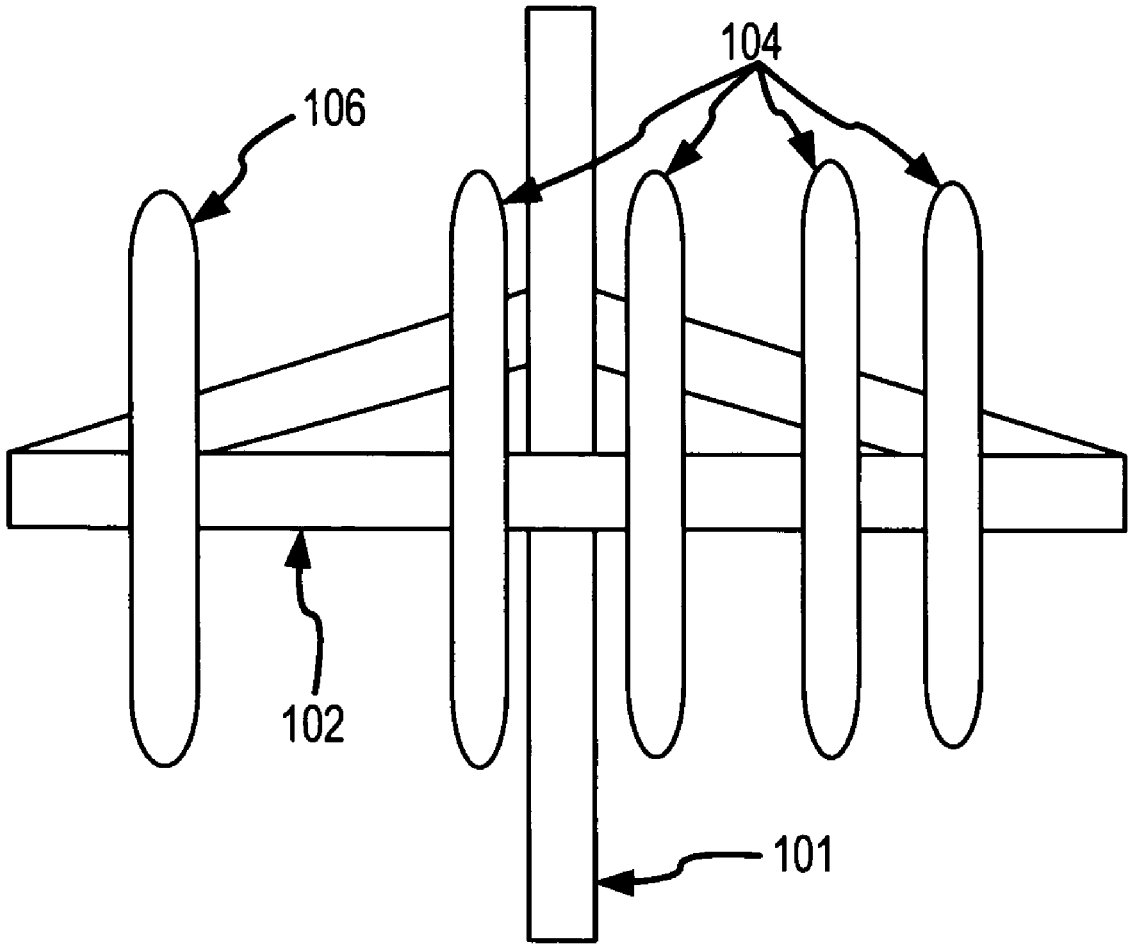
FIG. 1 is a diagram of a cell tower 101 in an example embodiment of the invention.

A Multi-link antenna array is a new concept to conserve the mounting space available on cell towers and minimize antenna leasing expenses. In this application the term "cell tower" includes all manner of cellular mounting structure, for example building sites, towers, treelike structures, and the like. In one embodiment of the current invention, an array of small antennas are mounted inside a radome enclosure. The size and shape of the radome enclosure matches the general size and shape of cellular antenna elements. This enables the array of small antennas, known as a multi-link antenna array, to be mounted onto cell towers or building rooftops in a similar fashion as a cellular antenna element and conform to present cell antenna leasing agreements. By matching the size and shape of the cellular antenna element, the multi-link antenna array will also have essentially the same wind loading as the cellular antenna element. FIG. 1 is a diagram of a cell tower 101 in an example embodiment of the invention. Cell tower 101 comprises antenna element mounting deck 102, a plurality of cellular antenna elements 104, and a multi-link antenna array 106. Antenna element mounting deck 102 is fixed to tower 101. The plurality of cellular antenna elements 104 are mounted to antenna element mounting deck 102 using a cellular antenna element mounting system (not shown). Multi-link antenna array 106 is also mounted to antenna element mounting deck 102 using the same cellular element mounting system. Typically, each element mounted onto the antenna element mounting deck 102 is charged a leasing fee under present cell antenna leasing agreements.

Figure 2:
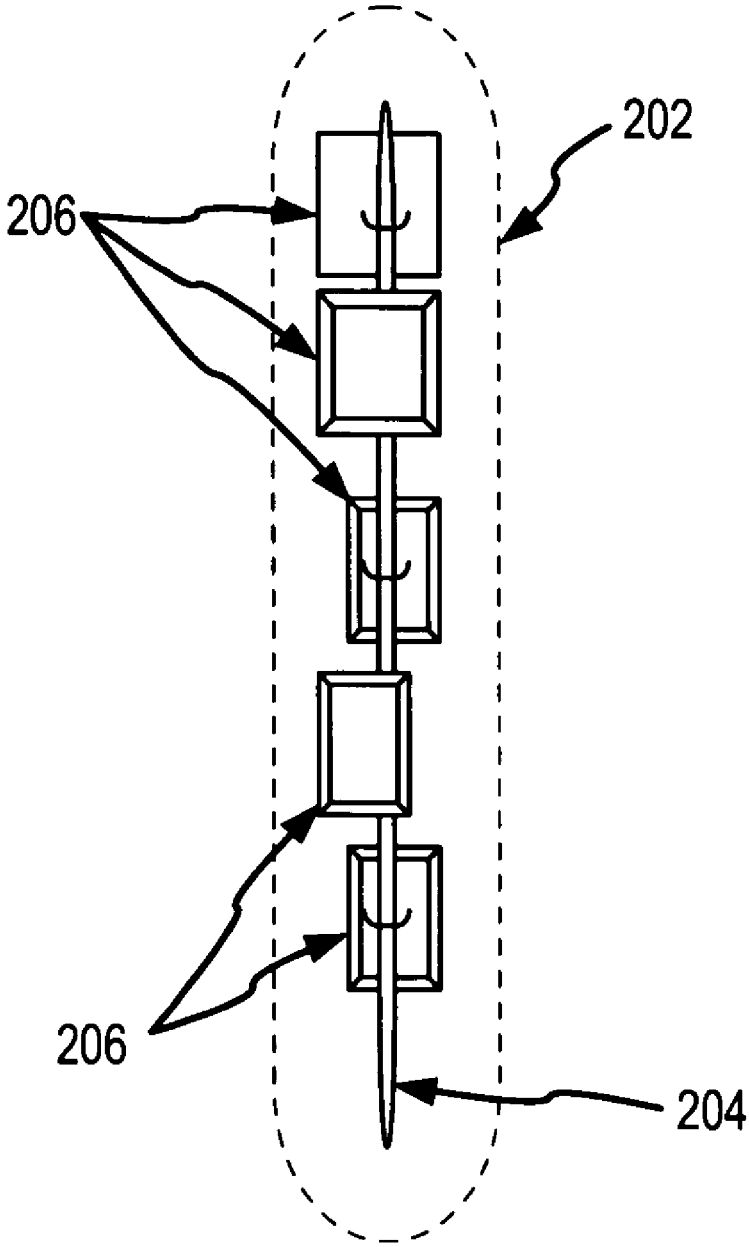
FIG. 2 is a cutaway diagram of a multi-link antenna array in an example embodiment of the invention.

FIG. 2 is a cutaway diagram of a multi-link antenna array in an example embodiment of the invention. Multi-link antenna array comprises a radome enclosure 202, an antenna mounting system 204 and a plurality of antennas 206. The radome enclosure 202 is configured to match the size and shape of the cellular antenna elements mounted onto a cell tower. Radome enclosure 202 may be any suitable shape, such as cylinder, rectangle, or the like. Radome enclosure 202 is also configured to mount to the antenna mounting system of a cell tower or a building site using the same mounting system used by the cellular antenna elements. Radome enclosure 202 is configured to resemble any one of the possible cellular antenna elements. Typical cellular antenna elements come in a number of shapes and sizes. One typical cellular antenna element is a cylindrical tube with rounded ends. The cylindrical tube is typically 10 to 16 inches in diameter and typically 6 feet in length. The cylindrical tube is typically mounted with a vertical orientation (as shown in FIG. 1). Another typical cellular antenna element is generally rectangular in shape. The generally rectangular shape may have rounded edges or chamfered edges. The generally rectangular shape is typically 10 to 14 inches in depth and width and approximately 6 feet in length. The dimensions given above for the sizes of a typical cellular antenna element are for illustration only. Other cellular antenna element sizes are possible. The example dimensions do not limit the radome size of the current invention.

In one example embodiment of the invention, the antenna mounting system 204 is a vertical post fixed inside the radome enclosure 202. The plurality of antennas 206 are mounted along the vertical post. The vertical post allows the plurality of antennas 206 to be aimed over the full 360 degree azimuth range. Other antenna mounting system that allow the full 360 degree azimuth range are possible and include a series of horizontal slots built into the radome enclosure, where each antenna mounts to the radome using one or more slots, a series of stackable disks, where each disk contains one antenna and where the disks can be rotated on top of each other, or the like. In another example embodiment of the invention, the antenna mounting system may limit the aim of the antennas to a subset of the full 360 degree azimuth range.

In one example embodiment of the invention, each of the plurality of antennas 206 is configured to operate at one of the common carrier bands, for example the 2, 4, 6, 10, 11, 18, 23, or 28 GHz band. When operating at one of the common carrier bands, antenna 206 may be a small patch antenna. Using a small sized patch antenna that fits into the form factor of the radome enclosure 202 may still allow an effective range of up to 10 miles for some of the common carrier bands. The small patch antennas handle all weather conditions without link path failures and operate through foliage albeit with some reduction in range when operating at the 2, 4, or 6 GHz frequencies. The higher frequency common carrier bands (10-28 GHz) may have a reduction in link distance and less tolerance for adverse weather conditions using the small patch antennas. Patch antennas are common for many bands but there are currently no commercially available certified small form factor patch type directional antennas that can be used with common carrier bands such as the 2, 4, 6, 10, 11, 18, 23, and 28 GHz common carrier point to point microwave (MW) bands. Matching a patch antenna to a given wavelength band is well known in the arts.

One of the costs for utilizing cellular towers is the number of cables or wires that run up the tower. In one example embodiment of the invention, the signal lines for each of the plurality of antennas mounted inside the radome enclosure are bundled into one cable that exits the radome. The cable may also include a power lead, a ground path, control lines or the like.

In one example embodiment of the invention, each of the plurality of antennas mounted inside the radome include a radio frequency (RF) head. The RF head converts an intermediate frequency (IF) into the actual frequency used by the antenna. In this way an IF signal can be sent up the tower and into the radome enclosure, instead of the RF signal. The signal lines used to transmit IF signals are typically smaller than lines designed to carry microwave RF signals. By bundling all the signal lines, and possibly the power line, ground path, and control lines into only one cable, the cost under the current cellular lease agreements may be minimized.

In one example embodiment of the invention, all the antennas inside a radome enclosure would be similar and would operate at essentially the same wavelength. In another example embodiment of the invention, a variety of different antennas, operating over a wide range of frequencies, would be mounted inside one radome enclosure. The variety of antenna types include: small patch type antennas, yagi antennas, parabolic antennas, helical antennas, circular polarizing elements, and the like. The multi-link antenna array may operate at one of, or a combination of, the following carrier bands: common carrier bands of 4, 6, 10, 11, 18, 23, 28 GHz; unlicensed bands ISM 2.4, UNII 5.8, 3.6 GHz; E-band 71-91 GHz and auctioned carrier bands applicable with PTP (point to point) radios: 700, 800, 1900 MHz, broadband radio service (BRS) 2.5 GHz and all LMDS bands (28 GHz through 39 GHz), Millimeter Wave radio bands, or any frequency where point to point microwave and millimeter wave radios are authorized to operate. One or more multi-link antenna arrays may be mounted onto a cellular tower, depending on the number of point-to-point links required at that site.

The multi-link antenna array of the current invention enables multiple point to point links to be supported from a single enclosure on a cell tower antenna mounting system or building mounting system. The small sized antennas permit the use of existing common carrier bands, such as the 4 GHz band, as cell site backhaul links. The common enclosure holding multiple antennas avoids the high leasing costs associated with mounting individual antennas. The individual antenna rotary mounting provides support of multiple microwave paths having full azimuth range of MW link propagation from a single host array and tower mounting.

Using the common carrier bands creates a lower one-way transmission delay than point to multi-point fixed wireless system or mesh wireless topologies. Transmission delay and differential delay for cell site backhaul are a particular challenge, especially as they relate to CDMA soft hand-offs and the ongoing migration to all IP end to end transmission for cellular originated and/or terminated traffic. In one example embodiment of the invention, the RF modems per link maybe also be incorporated into each antenna to improve S/N (signal to noise margin) and further increase link ranges.

Figure 3:
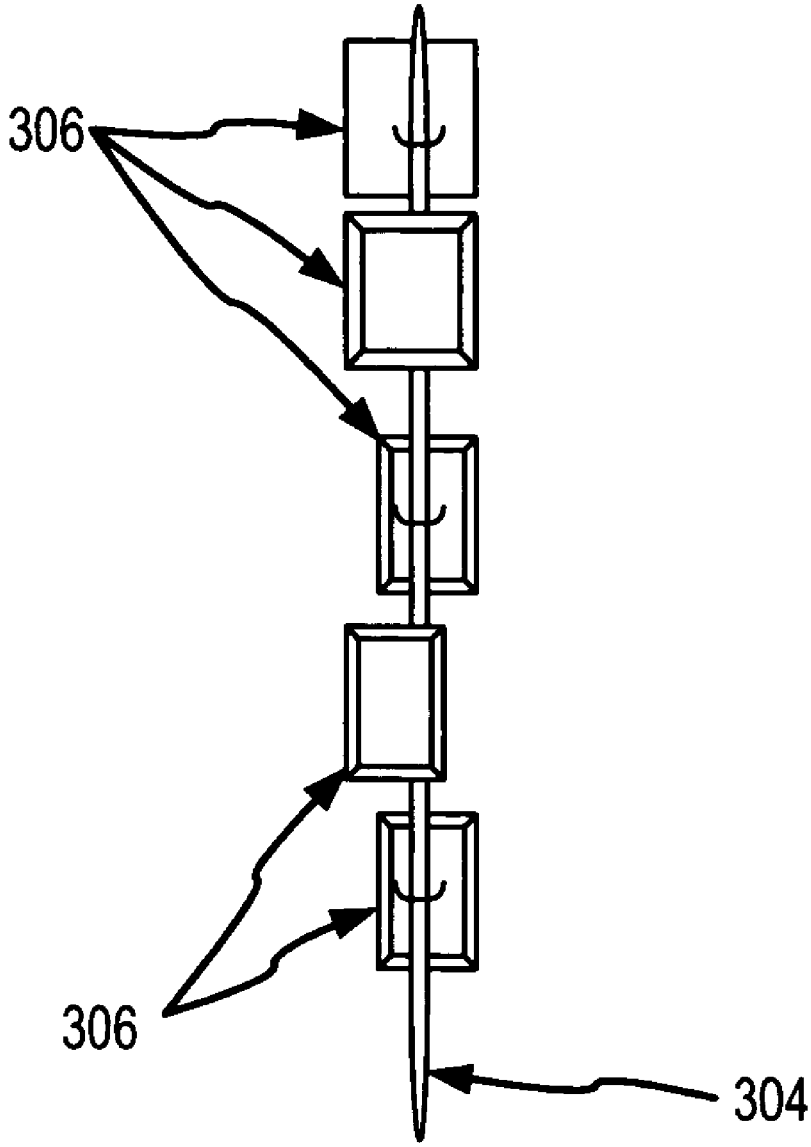
FIG. 3 is a cutaway diagram of a multi-link antenna array in another example embodiment of the invention.

FIG. 3 is a cutaway diagram of a multi-link antenna array in another example embodiment of the invention. Multi-link antenna array comprises an antenna mounting system 304 and a plurality of antennas 306. Multi-link antenna array does not contain a radome, but the plurality of antennas 306 are configured to fit inside the same size and shape as the cellular antenna elements mounted onto the cell tower. The antenna mounting system 304 is configured to mount to the antenna mounting system of a cell tower or antenna mounting system on a building site using the same mounting system used by the cellular antenna elements. Because the plurality of antennas 306 fit within the size of a cellular antenna element, and the multi-link antenna array mounts to a cell tower or building site using the space equivalent to one cellular antenna element, the multi-link antenna array may qualify as a single attachment to the cellular tower under the leasing agreement. This avoids the high leasing costs associated with mounting each antenna in the antenna array onto the cellular tower as an individual antenna element.

Figure 4:
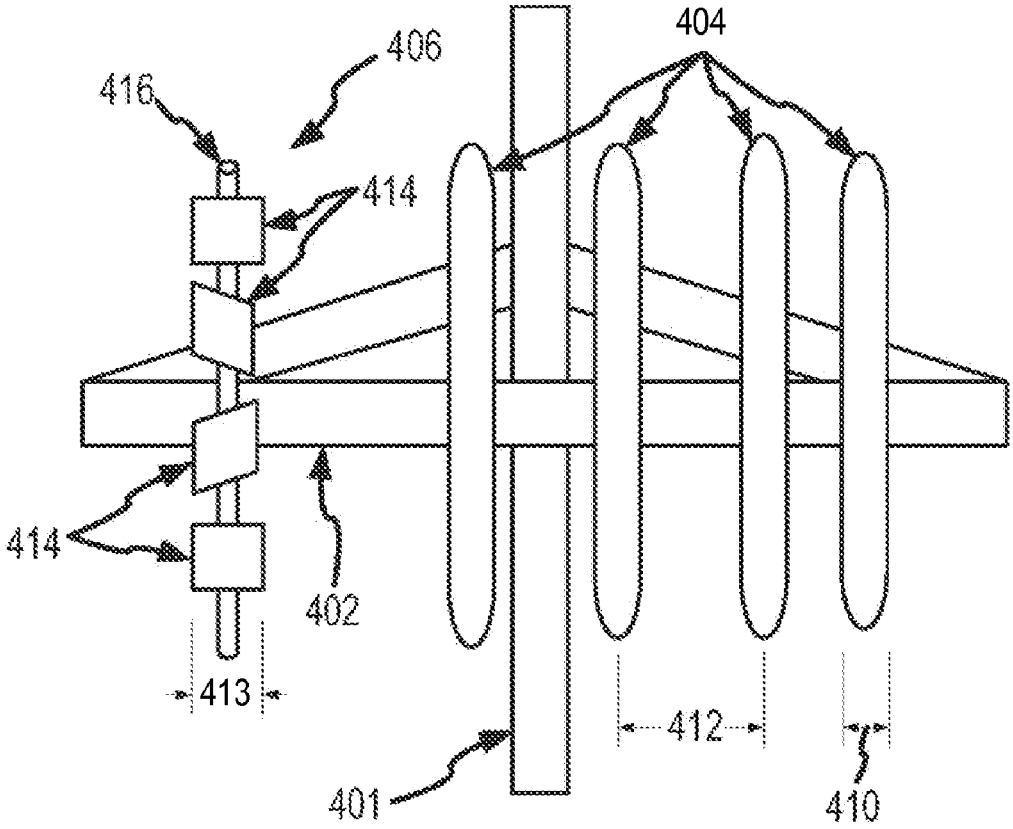
FIG. 4 is a diagram of a cell tower 401 in an example embodiment of the invention.

FIG. 4 is a diagram of a cell tower 401 in an example embodiment of the invention. Cell tower 401 comprises antenna element mounting deck 402, a plurality of cellular antenna elements 404, and a multi-link antenna array 406. Antenna element mounting deck 402 is fixed to tower 401. The plurality of cellular antenna elements 404 are mounted to antenna element mounting deck 402 using a cellular antenna element mounting system (not shown). Multi-link antenna array 406 is also mounted to antenna element mounting deck 402 using the same cellular element mounting system. Multi-link antenna array 406 comprises an antenna mounting system 416 and a plurality of antennas 414 mounted to the antenna mounting system 416. Multi-link antenna array 406 has a width 413. The cellular antenna elements also have a width 410. The cellular antenna elements 404 may have a minimum spacing 412 between the cellular antenna elements 404.

Figure 5A:
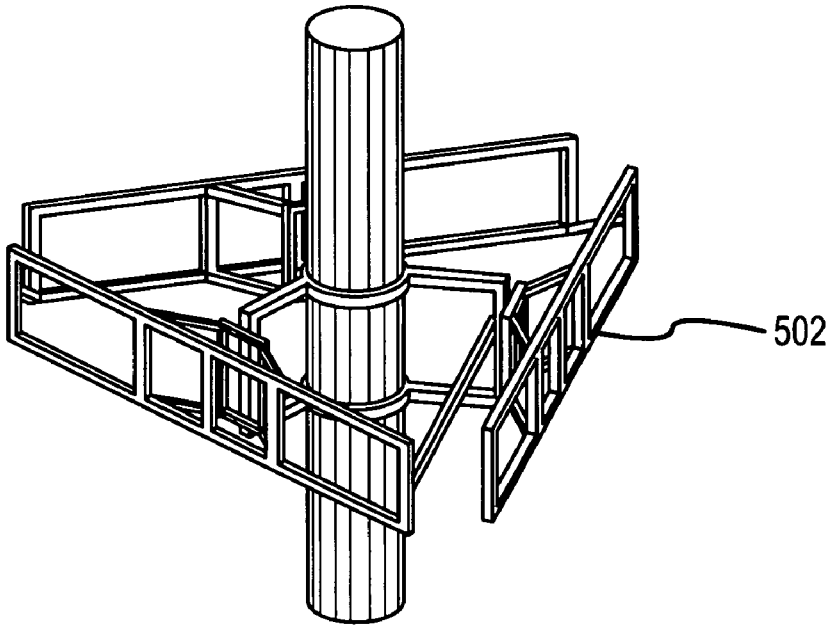
FIG. 5A (PRIOR ART)
FIGS. 5*a* and 5*b* are isometric views of two prior art cellular mounting decks.
Figure 5B:
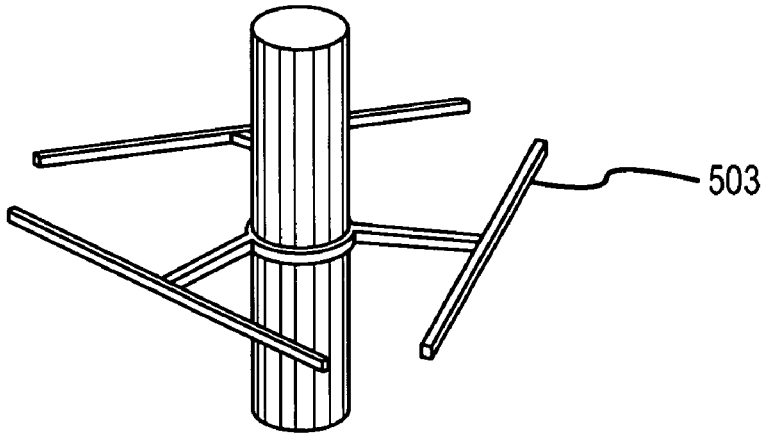
FIG. 5B (PRIOR ART)

Cellular tower lease agreements may vary in the detail that describes the size and shape of a cellular antenna element that may be mounted onto a cellular tower under the lease agreement. The detail level may vary between one lease agreement that specifies the exact size and shape of the cellular antenna element, to a lease agreement that only specifies the physical distance between cellular antenna elements 412. The size and shape of a cellular antenna element may be specified indirectly in the lease agreement by specifying the operating wavelength band and the output power for the cellular antenna element. In one example embodiment of the invention, the multi-link antenna array is configured to fit within the maximum size and space allowed under a cellular tower leasing agreement for a cellular antenna element. The size and shape allowed may vary depending on the leasing agreement for each tower. In one example embodiment of the invention, the width 413 of the multi-link antenna array 406 may be limited to the width 410 of a cellular antenna element 404. In another example embodiment of the invention, the width 413 of the multi-link antenna array 406 may be just smaller than the minimum spacing allowed between cellular antenna elements. At this size, two multi-link antenna arrays mounted side-by-side would almost touch. In one example embodiment of the invention, the width 413 of the multi-link antenna array would be limited to two feet. Multi-link antenna array 406 would mount to the mounting deck 402 using the same mounting system that the cellular antenna elements 404 use. Cellular antenna element mounting systems come in a variety of configurations. FIGS. 5*a* and 5*b* are isometric views of two example cellular mounting decks. FIG. 5*a* has a dual bar mounting system 502 and FIG. 5*b* shows a single bar mounting system 503. Because multi link antenna array 406 fits within the allowable size for a cellular antenna element and attaches to the antenna mounting structure 402 in the same way as the cellular antenna elements 404, the multi-link antenna array 406 may qualify as only one attachment under the lease agreement for the cellular tower and therefore be charged a single fee.

In another example embodiment of the invention, each antenna in the antenna array may contain motors that allow the individual antenna's to be aligned without having someone on top of the cell tower. In one example embodiment of the invention, the motors could be used by a technician that would adjust the direction the antenna pointed while looking at the current signal strength from the antenna. The technician may be on the ground near the tower, or may be at a site remote from the tower. In another example embodiment of the invention, the antennas could be re-positioned automatically using an automated servo system that would optimize the signal strength received by the antenna. The motors may be deployed in a one axis configuration or in a two axis configuration. In the one axis configuration, the motors would be configured to adjust the antennas in the azimuth direction. Having motors attached to the antennas in the antenna array allows the antennas to be adjusted or completely re-pointed without the aid of a tower crew.

We claim:

1. A multi-link antenna array, comprising:

an antenna mounting system configured to mount a plurality of antennas;

an array mounting system coupled to the antenna mounting system and configured to attach to a cellular antenna element mount;

the plurality of antennas attached to the antenna mounting system where the plurality of antennas fits inside a physical envelope, and where the physical envelope matches size and shape requirements for a cellular antenna element in a cellular leasing agreement.

2. The multi-link antenna array of claim 1 where a width of the physical envelope is approximately equal to a minimum spacing between two cellular antenna elements mounted on a cellular tower.

3. The multi-link antenna array of claim 1 where a width of the physical envelope is approximately equal to a width of the cellular antenna element.

4. The multi-link antenna array of claim 1 where the physical envelope has a maximum width of approximately two feet.

5. The multi-link antenna array of claim 1 where the physical envelope has generally cylindrical shape.

6. The multi-link antenna array of claim 5 where the generally cylindrical shape of the physical envelope has a maximum width of between 10 and 16 inches in diameter.

7. The multi-link antenna array of claim 5 where the generally cylindrical shape of the physical envelope has a diameter of approximately 12 inches and where the generally cylindrical shape of the physical envelope is approximately 6 feet in length.

8. The multi-link antenna array of claim 1 where the physical envelope has a generally rectangular shape.

9. The multi-link antenna array of claim 8 where the generally rectangular shape of the physical envelope has a width of approximately 12 inches, a length of approximately 12 inches and a height of approximately 6 feet.

10. The multi-link antenna array of claim 1 where at least one antenna of the plurality of antennas is configured to operate using a common carrier band.

11. The multi-link antenna array of claim 10 where the common carrier band is selected from the 2, 4, and 6 GHz common carrier bands.

12. The multi-link antenna array of claim 1 where at least one antenna of the plurality of antennas is configured to operate at a wavelength band selected from the group: broadband radio service (BRS) 2.5 GHz, local multipoint distribution service (LMDS 24 GHz-39 GHz), Unlicensed bands 2.4 GHz, 3.6 GHz, 5.8 GHz, and licensed cellular bands 800 MHz, 1900 MHz.

13. The multi-link antenna array of claim 1 where at least one antenna of the plurality of antennas selected from the group: a patch antenna, a parabolic antenna, a helical antenna, and a yagi antenna.

14. The multi-link antenna array of claim 1 where at least one antenna of the plurality of antennas includes a radio frequency (RF) head.

15. The multi-link antenna array of claim 1 where the antenna mount system is configured to allow the plurality of antennas to be aligned anywhere within a 360 degree azimuth range.

16. The multi-link antenna array of claim 1 where the antenna mount system is configured to mount the plurality of antennas that are essentially identical.

17. The multi-link antenna array of claim 1 where the antenna mount system is configured to mount the plurality of antennas that are configured for a plurality of different wavelength bands.

18. The multi-link antenna array of claim 1 where the antenna mount system comprises a vertical cylindrical rod.

19. The multi-link antenna array of claim 1 where the multi-link antenna array is mounted on a cell tower.

20. The multi-link antenna array of claim 1 further comprising:

a single cable exiting from a radome enclosure and configured to feed a plurality of signals to the plurality of antennas.

21. The multi-link antenna array of claim 20 where the single cable comprises a plurality of intermediate frequency (IF) signal lines and at least one power line.

22. The multi-link antenna array of claim 1 where at least one antenna of the plurality of antennas further comprises an RF modem.

23. The multi-link antenna array of claim 1 further comprising:

a first motor attached to a first antenna of the plurality of antennas and configured to move the first antenna in an azimuth direction.

24. The multi-link antenna array of claim 23 further comprising:

a second motor attached to the first antenna and configured to move the first antenna in a direction perpendicular to the azimuth direction.

25. The multi-link antenna array of claim 24 where the first motor is controlled remotely.

26. A method for creating a plurality of point-to-point links, comprising:

mounting a plurality of antennas onto an antenna mount, where the plurality of antennas fit inside a physical envelope and where the physical envelope matches size and shape requirements for a cellular antenna element in a cellular leasing agreement and where each of the plurality of antennas is configured to form one end of one of the plurality of point-to-point links;

attaching the antenna mount to a cellular tower using a cellular antenna element mounting system.

27. The method for creating a plurality of point-to-point links of claim 26 where a width of the physical envelope is approximately equal to a minimum spacing between two cellular antenna elements mounted on the cellular tower.

28. The method for creating a plurality of point-to-point links of claim 26 where a width of the physical envelope is approximately equal to a width of the cellular antenna element.

29. The method for creating a plurality of point-to-point links of claim 26 where the physical envelope has a maximum width of approximately two feet.

30. The method for creating a plurality of point-to-point links of claim 26 where the physical envelope has a generally cylindrical shape.

31. The method for creating a plurality of point-to-point links of claim 30 where the generally cylindrical shape of the physical envelope has a maximum width of between 10 and 16 inches in diameter.

32. The method for creating a plurality of point-to-point links of claim 30 where the generally cylindrical shape of the physical envelope has a diameter of approximately 12 inches and where the generally cylindrical shape of the physical envelope is approximately 6 feet in length.

33. The method for creating a plurality of point-to-point links of claim 26 where the physical envelope has a generally rectangular shape.

34. The method for creating a plurality of point-to-point links of claim 33 where the generally rectangular shape of the physical envelope has a width of approximately 12 inches, a length of approximately 12 inches and a height of approximately 6 feet.

35. The method for creating a plurality of point-to-point links of claim 26 where the plurality of antennas are aligned anywhere within a 360 degree azimuth range using the antenna mount.

36. The method for creating a plurality of point-to-point links of claim 26 where at least one of the plurality of antennas is configured to operate using a common carrier band.

37. The method for creating a plurality of point-to-point links of claim 36 where the common carrier band is selected from the 2, 4, and 6 GHz common carrier bands.

38. The method for creating a plurality of point-to-point links of claim 26 where at least one antenna of the plurality of antennas is configured to operate at a wavelength band selected from the group: broadband radio service (BRS) 2.5 GHz, local multipoint distribution service (LMDS 24 GHz-39 GHz), Unlicensed bands 2.4 GHz, 3.6 GHz, 5.8 GHz, and licensed cellular bands 800 MHz, 1900 MHz.

39. The method for creating a plurality of point-to-point links of claim 26 where at least one of the plurality of antennas includes an RF head.

40. The method for creating a plurality of point-to-point links of claim 26 where the plurality of antennas are configured for a plurality of different wavelength bands.

41. The method for creating a plurality of point-to-point links of claim 26 where the plurality of antennas are mounted using the antenna mount comprising a vertical cylindrical rod.

42. The method for creating a plurality of point-to-point links of claim 26 further comprising:

coupling a single cable into a radome enclosure where the single cable is configured to feed a plurality of signals to the plurality of antennas.

43. The method for creating a plurality of point-to-point links of claim 42 where the single cable comprises a plurality of IF signal lines and at least one power line.

44. The method for creating a plurality of point-to-point links of claim 26 where at least one of the plurality of point-to-point links is used as a backhaul link.

* * * * *